US008785782B2

(12) United States Patent
Kim et al.

(10) Patent No.: US 8,785,782 B2
(45) Date of Patent: Jul. 22, 2014

(54) UTP CABLE OF IMPROVED ALIEN CROSSTALK CHARACTERISTIC

(75) Inventors: Tae Woo Kim, Gumi-si (KR); Jong Seb Baeck, Gumi-si (KR)

(73) Assignee: Hyundai Mobis Co., Ltd, Yongin-si, Gyeonggi-do (KR)

( * ) Notice: Subject to any disclaimer, the term of this patent is extended or adjusted under 35 U.S.C. 154(b) by 724 days.

(21) Appl. No.: 12/985,086

(22) Filed: Jan. 5, 2011

(65) Prior Publication Data

US 2011/0168426 A1 Jul. 14, 2011

(30) Foreign Application Priority Data

Jan. 8, 2010 (KR) ..... 10-2010-0001523
Sep. 29, 2010 (KR) ..... 10-2010-0094254
Sep. 29, 2010 (KR) ..... 10-2010-0094257

(51) Int. Cl.
*H01B 7/00* (2006.01)
*H01B 11/02* (2006.01)
*H01B 11/06* (2006.01)

(52) U.S. Cl.
USPC ..... 174/113 C; 174/113 R

(58) Field of Classification Search
USPC ..... 174/113 C, 113 R
See application file for complete search history.

(56) References Cited

U.S. PATENT DOCUMENTS 1,389,143 A * 8/1921 Kempton ..... 138/141
3,363,047 A * 1/1968 Grove ..... 174/15.7
6,365,836 B1 * 4/2002 Blouin et al. ..... 174/113 C
6,787,697 B2 * 9/2004 Stipes et al. ..... 174/36
7,115,815 B2 * 10/2006 Kenny et al. ..... 174/113 R
7,173,189 B1 * 2/2007 Hazy et al. ..... 174/110 R
7,196,271 B2 * 3/2007 Cornibert et al. ..... 174/113 C
7,449,638 B2 * 11/2008 Clark et al. ..... 174/113 C
7,534,964 B2 * 5/2009 Clark et al. ..... 174/113 R
7,592,550 B2 * 9/2009 Stutzman et al. ..... 174/113 C
7,705,244 B2 * 4/2010 Fok ..... 174/113 R
7,772,494 B2 * 8/2010 Vexler et al. ..... 174/113 R
7,897,875 B2 * 3/2011 Gareis ..... 174/113 R
8,030,571 B2 * 10/2011 Vexler et al. ..... 174/110 R
8,198,536 B2 * 6/2012 Clark ..... 174/113 R
8,375,694 B2 * 2/2013 Kenny et al. ..... 57/314
8,426,732 B1 * 4/2013 Waldner ..... 174/110 R
8,455,762 B2 * 6/2013 Vexler et al. ..... 174/113 R
8,492,654 B2 * 7/2013 Al-Saqabi ..... 174/113 C
2005/0092515 A1 * 5/2005 Kenny et al. ..... 174/113 R
2005/0247479 A1 * 11/2005 Kenny et al. ..... 174/113 R
2005/0279528 A1 * 12/2005 Kenny et al. ..... 174/113 R
2007/0144763 A1 * 6/2007 Park et al. ..... 174/113 C
2008/0164049 A1 * 7/2008 Vexler et al. ..... 174/113 R
2009/0223694 A1 * 9/2009 Nordin et al. ..... 174/34
2009/0294146 A1 * 12/2009 Nordin et al. ..... 174/33

(Continued)

FOREIGN PATENT DOCUMENTS

JP 2008097872 A * 4/2008

*Primary Examiner* — Jeremy C Norris
*Assistant Examiner* — Nathan Milakovich
(74) *Attorney, Agent, or Firm* — Sherr & Jiang, PLLC

(57) ABSTRACT

An UTP cable of improved alien crosstalk characteristic according to present invention comprises, at least two pairs that is formed to have pitch by twisting at least two wires coated by insulation material; a separator including partition wall separating the pairs from one another; a sheath wrapping the pairs and the separator; and a spacer separating the pairs from the sheath, wherein the partition wall of the separator is formed to make an acute angle θ with the spacer.

4 Claims, 3 Drawing Sheets

(56) References Cited

U.S. PATENT DOCUMENTS

| | | | | |
|---|---|---|---|---|
| 2010/0218973 | A1* | 9/2010 | Camp et al. | 174/113 C |
| 2011/0174516 | A1* | 7/2011 | Baeck et al. | 174/113 C |
| 2011/0259626 | A1* | 10/2011 | Speer | 174/113 C |
| 2012/0267142 | A1* | 10/2012 | Nordin et al. | 174/102 R |
| 2012/0318558 | A1* | 12/2012 | Bolouri-Saransar et al. | 174/113 R |
| 2013/0277090 | A1* | 10/2013 | Nordin et al. | 174/113 C |

* cited by examiner

*-Prior Art-*

UTP CABLE OF IMPROVED ALIEN CROSSTALK CHARACTERISTIC

CROSS REFERENCE TO PRIOR APPLICATIONS

The present application claims priority under 35 U.S.C. §119 to Korean Patent Application Nos. 10-2010-0001523 (filed on Jan. 8, 2010), 10-2010-0094254 (filed on Sep. 29, 2010) and 10-2010-0094257 (filed on Sep. 29, 2010), which are all hereby incorporated by reference in their entirety.

BACKGROUND

1. Technical Field

The present invention relates to an UTP cable, more specifically, an UTP cable in which crosstalk between pairs and alien crosstalk between adjacent cables are prevented to enhance transmission capacity.

2. Related Art

Generally, UTP (Unshielded Twisted Pair) cable which is used for communication cable is fabricated in the following steps: electric wires including conductor such as copper or etc. coated by insulation material are twisted to form pair, then four pairs are collected and coated by insulation material.

As information technology like ATM and Ethernet or the like develops recently, communication cable appears to be more important, and it has been desired to increase the information transmission capacity of the UTP cable, and the communication cable has been developed to increase its information transmission capacity.

In the meanwhile, the communication cable are classified by the identification characters such as category (or Cat.) and number in accordance with its signal transmission capacity under international agreement, wherein the bigger number means the higher transmission capacity.

For example, communication of Cat. 3 can transmit signal of 16 MHz, Cat. 4 can 20 MHz, and Cat. 5 can 100 MHz, wherein the higher modulation frequency is used, the more information can be transmitted.

However, as the higher modulation frequency is used, the noise due to the crosstalk among the cables and change of the impedance in the conducting wires are increased, which results in a problem that the assortment of the signals gets more difficult in the signal receiver.

For this reason, up to recently, the limit of the UTP cable's signal transmission capacity has been seemed to be around 155 Mbps (Megabit per sec).

However, in view of the developing trend of the related technology such as movie transmission technology and etc., the cable which can transmit information in a higher level will be needed in the near future, so that major cable manufacturers and related system manufacturers are competitively investing for satisfying this need.

However, for improvement of the transmission capacity, usually higher frequency is used, and that results in problems of crosstalk in and out of the UTP cable, so it is very important to lessen the crosstalk for improvement of signal transmission capacity.

The crosstalk depends on outer diameter of wire, pitch, and etc., it is very important to tune properly the factors for excellent transmission characteristic.

FIG. 1 is cross sectional view of a conventional UTP cable.

Referring to FIG. 1, the conventional UTP cable comprises plural pairs 2 that is constituted by twisting two wires 1 coated by insulation material to form a pitch, a separator of "+" shape for separating the plural pairs from one another, and sheath wrapping the pairs 2 and the separator 3.

Here, in the conventional UTP cable, a spacer 5 for separating the pairs 2 from the sheath 4 by a distance is integrally formed with the sheath 4, and the spacer 5 is protruded to inner side of the sheath 4 for separating the pairs 2 from the sheath 4.

Here, the conventional UTP cable has the following problems, even though it has advantage of effective separating the pairs 2 from the sheath 4.

The UTP cable is manufactured to have different structural condition (diameter of conductor, diameter of wire, pitch, and etc.) of the pairs 2, so the pairs 2 have different electric characteristic from one another, and a pair that has the longest pitch is most strongly influenced by alien crosstalk.

However, in the conventional UTP cable, the pairs 2 are spaced from the sheath with a same distance by the separator 3 and the spacer 5, so effect by pitch difference is not considered for alien crosstalk characteristic.

That is, distances between center of the UTP cable and centers of each pair 2 are all same, regardless of different alien crosstalk characteristic of each pair that has different electric characteristic from one another, crosstalk decrease effect by spacing distance only is expected.

And, for the conventional UTP cable, alien crosstalk is lessened only by size of spacer 5 and spacing distance, so diameter of cable should be larger to minimize the alien crosstalk.

And, undesired spacing distance is occurred to pair with shortest pitch that has relatively good characteristic against alien crosstalk, so manufacturing of UTP cable is ineffective.

SUMMARY

The purpose of the present invention is to solve above-described problems, and is to provide UTP cable that can lessen alien crosstalk effectively by adjusting position of each pair with providing separator of specific shape that separates each pair from one another.

Another purpose of the present invention is to provide UTP cable in which pair of longest pitch is positioned to near center of the cable, so largest spacing distance between pairs that has the same pitch in adjacent cables can be obtained.

Another purpose of the present invention is to provide UTP cable that can lessen alien crosstalk effectively without increasing outer diameter of the cable by adjusting position of each pair in sheath.

To achieve said object, an UTP cable of improved alien crosstalk characteristic according to present invention comprises, at least two pairs that is formed to have pitch by twisting at least two wires coated by insulation material; a separator including partition wall separating the pairs from one another; a sheath wrapping the pairs and the separator; and a spacer separating the pairs from the sheath, wherein the partition wall of the separator is formed to make an acute angle θ with the spacer.

Here, the separator includes supplemental partition wall protruding from center portion of the partition wall, and the partition wall and the supplemental partition wall may make a slope for each other.

And, the spacer may include support portion facing the pairs and ribs for separating the support portion from the sheath.

Preferably, the support portion includes two support portion connected with both end portions of the partition wall, and plural ribs are connected to the two support portion respectively.

Preferably, ribs of different height or thickness are formed to respective two support portions connected with both end portions of the partition wall.

In the meanwhile, an UTP cable of improved alien crosstalk characteristic according to another embodiment of the present invention comprises at least two pairs that is formed to have pitch by twisting at least two wires coated by insulation material; a separator including partition wall separating the pairs from one another; a sheath wrapping the pairs and the separator; and a spacer separating the pairs from the sheath, wherein the spacer includes first support portion that slopes away from the partition wall and second support portion that is connected with the first support portion, and the second support portion slopes away from the first support portion.

Here, the separator includes supplemental partition wall protruding from center portion of the partition wall, and the partition wall and the supplemental partition wall may make a slope for each other.

And, the first support portion and the second support portion may include ribs for separating the support portions from the sheath.

Preferably, two first support portions are connected with both end portions of the partition wall, and ribs of different height or thickness are connected to the first support portions respectively.

Preferably, third support portion that slopes away from the second support portion is connected to the end portion of the second support portion.

In the meanwhile, an UTP cable of improved alien crosstalk characteristic according to another embodiment of the present invention comprises at least two pairs that is formed to have pitch by twisting at least two wires coated by insulation material; a separator including partition wall separating the pairs from one another; a sheath wrapping the pairs and the separator; and a spacer separating the pairs from the sheath, wherein the spacer includes support portion that faces the pairs and rib that is positioned between the support portion and the sheath, and the rib is positioned between the pair that has the longest pitch and the sheath.

Preferably, the separator includes supplemental partition wall protruding from center portion of the partition wall, and the partition wall and the supplemental partition wall make a slope for each other.

And, two support portions are connected with both end portions of the partition wall, and ribs of different height or thickness are connected to the support portions respectively.

Preferably, the support portion has a cross sectional shape of line bended by a specific degree of angle.

In the meanwhile, an UTP cable of improved alien crosstalk characteristic according to another embodiment of the present invention comprises at least two pairs that is formed to have pitch by twisting at least two wires coated by insulation material; a separator including partition wall separating the pairs from one another; a sheath wrapping the pairs and the separator; and a spacer separating the pairs from the sheath, wherein the spacer includes first spacer that slopes away from one end portion of the partition wall and second spacer that slopes away from the other end portion of the partition wall, pair that has the longest pitch is positioned at a position where the first spacer meets with the partition wall in an acute angle, and pair that has secondly longest pitch is positioned at a position where the second spacer meets with the partition wall in an acute angle.

Preferably, the separator includes supplemental partition wall protruding from center portion of the partition wall, and the partition wall and the supplemental partition wall make a slope for each other.

And, the first spacer and the second spacer respectively may include support portion facing the pairs and rib for separating the support portion from the sheath.

Preferably, ribs of different height or thickness are formed to the first spacer and the second spacer respectively.

Preferably, the support portion has a cross sectional shape of line bended by a specific degree of angle.

In the meanwhile, an UTP cable of improved alien crosstalk characteristic according to another embodiment of the present invention comprises at least two pairs that is formed to have pitch by twisting at least two wires coated by insulation material; a separator including partition wall separating the pairs from one another; and a sheath wrapping the pairs and the separator; wherein the pairs include first pair of pitch $p_1$, second pair of pitch $p_2$, third pair of pitch $p_3$, and fourth pair of pitch $p_4$, when distances from center of cable to center of respective pair is designated by $V_1$, $V_2$, $V_3$, and $V_4$, and the shortest distance from outer surface of the sheath to center of the respective pair is designated by $d_1$, $d_2$, $d_3$, and $d_4$, the cable is configured to meet the following condition, if, $p_1>p_2>p_3>p_4$, then, $V_1 \leq V_2 < V_3$ and $V_1 \leq V_2 < V_4$, and $d_1 \geq d_2 > d_3$ and $d_1 \geq d_2 > d_4$.

Here, the UTP cable may further comprise a spacer separating the pairs from the sheath.

And, the separator includes partition wall for separating the first pair from the second pair and supplemental partition wall protruding from center portion of the partition wall, and the partition wall and the supplemental partition wall may make a slope for each other.

And, the spacer may include support portion facing the pairs and rib for separating the support portion from the sheath.

Preferably, the support portion slopes away from the partition wall.

Preferably, the support portion includes two support portions connected with both end portions of the partition wall, and plural ribs are connected to the two support portions respectively.

And, ribs of different height or thickness may be formed to respective two support portions connected with both end portions of the partition wall.

Here, the support portion may include first support portion that is directly connected to the partition wall and second support portion that slopes away from the first support portion.

Preferably, the support portion further includes third support portion that slopes away from the second support portion.

BRIEF DESCRIPTION OF THE DRAWINGS

The drawings attached illustrate the preferable embodiment of the present invention, only helps further understanding of the idea of the present invention along with the detailed description of the present invention described in the below, and thus the present invention is not limitedly interpreted to the matters shown in the drawings.

DESCRIPTION OF EXEMPLARY EMBODIMENTS

Hereinafter, the present invention is described in detail with reference to the attached drawings.

Before the detailed description, it should be noted that the terms used in the present specification and the claims are not to be limited to their lexical meanings, but are to be interpreted to conform with the technical idea of the present invention under the principle that the inventor can properly define the terms for the best description of the invention made by the inventor.

Therefore, the embodiments and the constitution illustrated in the attached drawings are merely preferable embodiments according to the present invention, and thus they do not express all of the technical idea of the present invention, so that it should be understood that various equivalents and modifications can exist which can replace the embodiments described in the time of the application.

Figure 1:
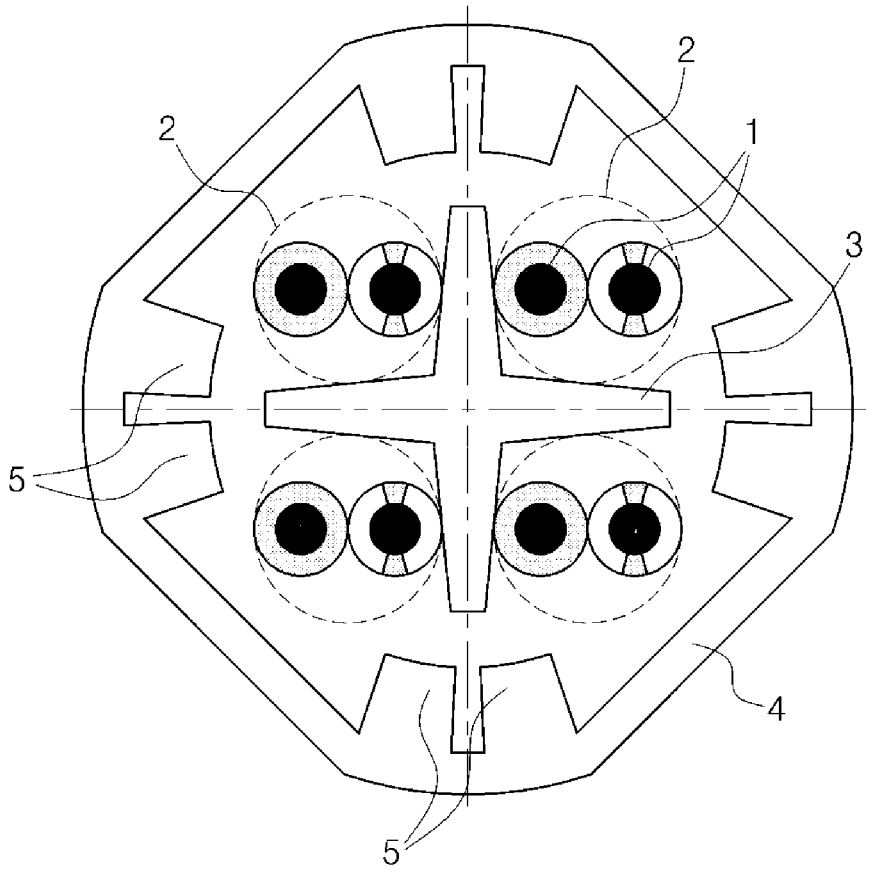
FIG. 1 is a cross sectional view of conventional UTP cable.
Figure 2:
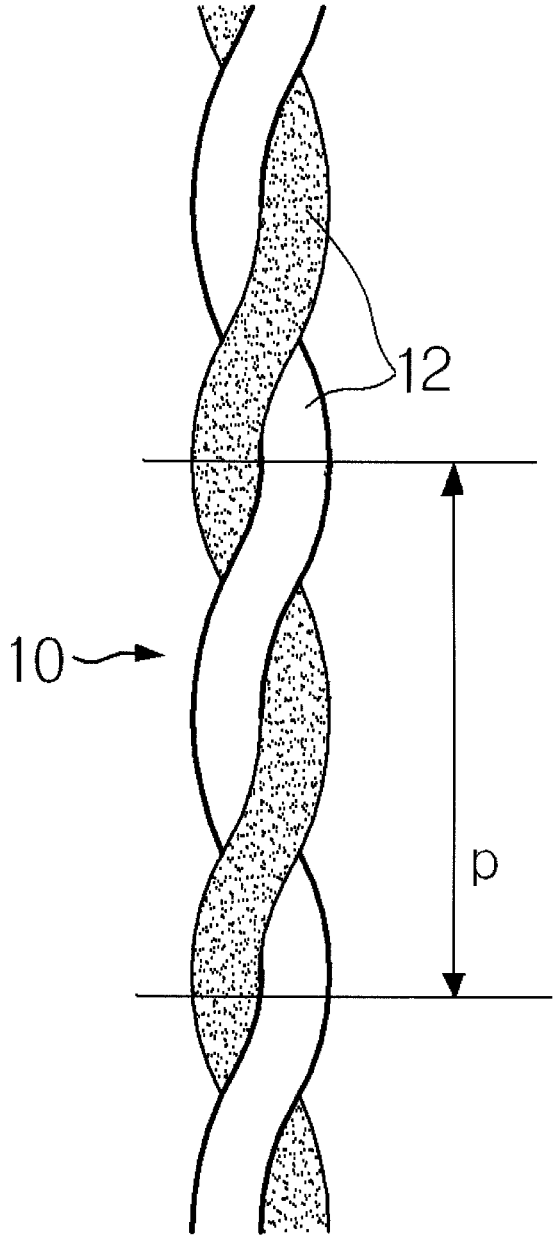
FIG. 2 is a schematic view of pitch of pair formed by twisting wires.
Figure 3:
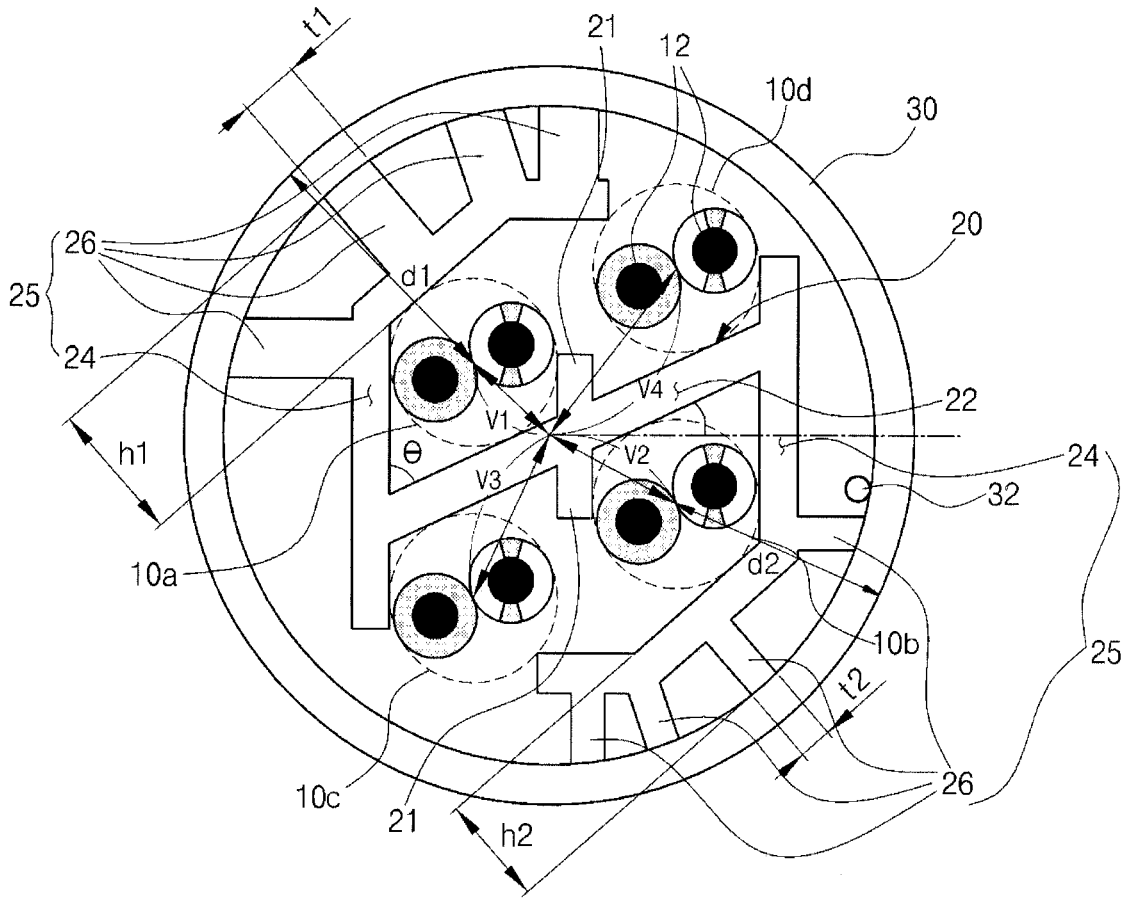
FIG. 3 is a cross sectional view of an UTP cable according to an embodiment of the present invention.

FIG. 2 is a schematic view of pitch of pair formed by twisting wires, and FIG. 3 is a cross sectional view of UTP cable according to an embodiment of the present invention.

Referring to FIG. 2 and FIG. 3, an UTP cable according to present invention comprises, at least two pairs 10 that is formed to have pitch p by twisting at least two electric wires 12 coated by insulation material, a separator 20 including partition wall separating 22 the pairs 10 from one another, a sheath 30 wrapping the pairs 10 and the separator 20, and a spacer 25 separating the pairs 10 from the sheath 30, wherein the partition wall 22 of the separator 20 is formed to make an acute angle θ with the spacer 25.

Here, said electric wires 12 are formed by straight conductor such as copper coated by insulation material for transmitting data transformed into electric signal.

Said insulation material is formed by high molecular resin LDPE (Low Density Polyethylene), HDPE (High Density Polyethylene), FEP (Fluorinated Ethylene Propylene), etc. that has low dielectric constant and are easy to handle.

And, said pairs 10 are formed by twisting the electric wires 12 by constant pitch p, generally as seen in FIG. 2, two electric wires 12 are twisted, but not limited to this and various modifications can be done.

And, the pairs 10 can be formed by coating surface of the electric wires 12 for improving transmission characteristic by decreasing signal interference through shielding electromagnetic wave.

Generally at least two pairs 10 are comprised in the UTP cable, as seen in FIG. 3, first pair 10*a*, second pair 10*b*, third pair 10*c*, and fourth pair 10*d* are comprised in the sheath 30, but not limited to this and various modifications can be done.

In the meanwhile, to restrain the interference between respective pair 10*a*, 10*b*, 10*c*, 10*d* in the cable, the pairs are twisted by different pitch p from one another.

And, hereinafter for clear explanation, pitch of the pairs 10*a*, 10*b*, 10*c*, 10*d* are set to be for example, pitch of first pair 10*a*>pitch of second pair 10*b*>pitch of third pair 10*c*>pitch of fourth pair 10*d*.

Here, separator 20 for separating the pairs 10*a*, 10*b*, 10*c*, 10*d* from one another is longitudinally inserted into the sheath 30 for minimizing inner interference between the pairs.

Here, the separator 20 is made from polyethylene or incombustible polyethylene or polypropylene or incombustible polypropylene or fluoroplastic, and the fluoroplastic may be one of fluoroethylenepropylene (FEP) or monofluoroalalkoxy (MFA) or ethylene chlor trifluoro ethylene (ECTFE) to separate the pairs 10*a*, 10*b*, 10*c*, 10*d* from one another.

That is, the pairs 10*a*, 10*b*, 10*c*, 10*d* are spaced away from one another by the separator 20 positioned at center portion of the UTP cable, and by the separation interference between the pairs are lessened.

Here, as seen in FIG. 3, the separator includes partition wall 22 for separating the pairs 10*a*, 10*b*, 10*c*, 10*d* from one another and spacer 25 for separating the pairs 10*a*, 10*b*, 10*c*, 10*d* from the sheath 30.

In the separator 20, the partition wall 22 and the spacer 25 is formed integrally, and as seen in FIG. 3, the partition wall 22 is formed to meet with the spacer 25 by a specific angle θ in cross sectional view.

That is, as the partition wall 22 is positioned to make an acute angle with the spacer 20, position of the pairs 10*a*, 10*b*, 10*c*, 10*d* can be adjusted respectively according to pitches p of them.

And, as seen in FIG. 3, at center portion of the partition wall 22, supplemental partition wall 21 protruding toward up and down from the partition wall may be formed.

Here, by the supplemental partition wall 21 and the partition wall 22, the pairs 10*a*, 10*b*, 10*c*, 10*d* are spaced away from one another, so inner interference between the pairs are lessened.

In the meanwhile, as seen in FIG. 3, the spacer 25 may include plural ribs 26 and support portions 24 for supporting the ribs 26.

That is, by the ribs 26 and the support portion 24, the pairs 10*a*, 10*b*, 10*c*, 10*d* can be spaced away from the sheath 30.

And, the support portions 24 extend from both end portions of the partition wall 22, and the support portions 24 as seen in FIG. 3, are formed to be inclined by a specific angle along inner surface of the sheath 30.

By positioning the pairs 10*a*, 10*b*, 10*c*, 10*d* appropriately at spaces formed by the partition wall 22 and the support portions 24 according to pitches p of the pairs, inner interference between the pairs 10*a*, 10*b*, 10*c*, 10*d* and alien crosstalk by adjacent another UTP cable can be effectively prevented.

Here, cross sectional thickness t1, t2 or height h1, h2 of the spacer 25 may be different according to pitch p of the pair 10.

Preferably, as the pitch p of the pair is longer, cross sectional thickness or height of the spacer 25 that is neighboring the pairs may be larger.

That is, cross sectional thickness t1 or height h1 of spacer 25 that is neighboring the first pair 10*a* that has the longest pitch p is larger than cross sectional thickness t2 or height h2 of spacer 25 that is neighboring the second pair 10*b* that has shorter pitch p than the first pair 10*a*.

By that, the first pair 10*a* is positioned at nearest position from center of the cable in the sheath 30, so the first pair 10*a* that has the longest pitch p can be spaced away from another pair that has the same pitch p with the first pair in another neighboring UTP cable, therefore alien crosstalk can be prevented.

And, as above described, distances from center of the UTP cable to the pairs 10 in cross section can be different from one another according to pitches p of them 10.

Preferably, as the pitch p of the pair is longer, distances V1, V2, V3, V4 between center of the UTP cable and center of each pair 10 may be shorter.

That is, as seen in FIG. 3, distance V1 between center of the UTP cable and the first pair 10*a* is not larger than distance V2 between center of the UTP cable and the second pair 10*b*, and the V1 and V2 is smaller than distance V3 between center of the UTP cable and the third pair 10*c* and distance V4 between center of the UTP cable and the fourth pair 10*d*.

And, the minimum distance d1 from outer surface of the sheath 30 to center of the first pair 10*a* is not larger than the minimum distance d2 from outer surface of the sheath 30 to center of the second pair 10*b*, and the d1 and d2 are larger than the minimum distances d3 and d4 that is from outer surface of the sheath 30 to centers of the third pair 10*c* and fourth pair 10*d* respectively.

Generally, data loss and distortion by alien crosstalk is determined by pitch p of the pair, and as the pitch is longer, influence by alien crosstalk becomes larger.

So, by positioning the first pair 10*a* that has the longest pitch among the pairs to the nearest position from the center of the cable, influence by alien crosstalk can be prevented.

And, the UTP cable comprises sheath 30 to form external appearance wrapping the twisted total pairs 10*a*, 10*b*, 10*c*, 10*d* and the separator 20.

Here, the sheath 30 protects the pairs 20 mechanically and shielding alien cross talk generated by electromagnetic wave from adjacent other cable or electric equipment.

Generally, the sheath 30 is formed by insulation material such as high molecular resin for example, polyethylene, PVC, or Olefin system and preferably by 0.3~1.5 mm thickness.

Because, if the thickness of the sheath 30 is under 0.3 mm, the electric wires 10 can not be protected from the alien crosstalk, and the thickness is over 1.5 mm, the weight of the cable is increased by the thickness and the flexibility of the cable is decreased.

Preferably, to improve the alien crosstalk shielding effect, electromagnetic wave shielding sheath (not illustrated) formed by conductive material can be comprised in the sheath 30.

And, UTP cable according to present invention may comprise ripcord 32 that is inserted into the cable longitudinally for easy breakaway of the sheath 30.

As described above, by the present invention alien crosstalk can be effectively prevented by adjusting position of each pair with providing separator of specific shape separating each pair, and by positioning pair of the longest pitch to near center of the cable, so largest spacing distance between pairs that has the same pitch in adjacent cables can be obtained.

And, alien crosstalk can be effectively lessened without increasing outer diameter of the cable by adjusting positions of pairs in sheath.

Although the present invention has been described with reference to the specified examples in the above, but the idea of the present invention is not limited to the above described matters and various changes and modifications can be made within the equivalent scope of the present invention and the following claims by the ordinary-skilled person of the art.

What is claimed is:

1. An Unshielded Twisted Pair (UTP) cable of improved alien crosstalk characteristic, comprising:

at least two pairs, wherein each pair is formed by individually twisting two respective wires coated by an insulation material;

a separator including a partition wall and a supplemental partition wall which separate the pairs from one another, wherein the supplemental partition wall protrudes from a center portion of the partition wall, wherein a first side of the supplemental partition wall forms a first acute angle with the partition wall and a second side of the supplemental partition wall opposite to the first side forms a first obtuse angle with the partition wall;

a sheath wrapping the pairs and the separator; and a spacer separating the pairs from the sheath, wherein the spacer includes a support portion facing the pairs and having a first portion and a second portion positioned opposite to the first portion over the partition wall, wherein the partition wall of the separator forms a second acute angle with the first portion of the support portion of the spacer and forms a second obtuse angle with the second portion of the support portion of the spacer.

2. The UTP cable of improved alien crosstalk characteristic according to claim 1, wherein, the spacer further includes ribs protruded from the support portion and separating the support portion from the sheath.

3. The UTP cable of improved alien crosstalk characteristic according to claim 1, wherein, the support portion includes first and second supports connected with both end portions of the partition wall, and plural ribs are connected to the first and second supports respectively.

4. The UTP cable of improved alien crosstalk characteristic according to claim 3, wherein, said plural ribs have different height or thickness from each other and said plural ribs are formed at respective first and second supports connected with both end portions of the partition wall.

* * * * *

UNITED STATES PATENT AND TRADEMARK OFFICE

CERTIFICATE OF CORRECTION

PATENT NO. : 8,785,782 B2
APPLICATION NO. : 12/985086
DATED : July 22, 2014
INVENTOR(S) : Tae Woo Kim and Jong Seb Baeck It is certified that error appears in the above-identified patent and that said Letters Patent is hereby corrected as shown below:

On the title page item (73), please delete "HYUNDAI MOBIS Co., Ltd, Yongin-si, Gyeonggi-do, Republic of Korea" and insert --LS Cable Ltd., Anyang-si, Gyeonggi-do, Republic of Korea--.

Signed and Sealed this
Twenty-first Day of April, 2015

Michelle K. Lee

Michelle K. Lee
*Director of the United States Patent and Trademark Office*